US011453134B2

(12) United States Patent
Bin Othman

(10) Patent No.: US 11,453,134 B2
(45) Date of Patent: Sep. 27, 2022

(54) MULTI-BLADED AXE

(71) Applicant: Abdul Razak Bin Othman, Selangor (MY)

(72) Inventor: Abdul Razak Bin Othman, Selangor (MY)

(73) Assignee: Abdul Razak Bin Othman, Selangor (MY)

( * ) Notice: Subject to any disclaimer, the term of this patent is extended or adjusted under 35 U.S.C. 154(b) by 0 days.

(21) Appl. No.: 17/010,423

(22) Filed: Sep. 2, 2020

(65) Prior Publication Data

US 2021/0078189 A1 Mar. 18, 2021

Related U.S. Application Data

(60) Provisional application No. 62/901,693, filed on Sep. 17, 2019.

(51) Int. Cl.
*B26B 3/04* (2006.01)
*B26B 23/00* (2006.01)
*A63B 69/00* (2006.01)

(52) U.S. Cl.
CPC ..... *B26B 3/04* (2013.01); *B26B 23/00* (2013.01); *A63B 2069/0044* (2013.01)

(58) Field of Classification Search
CPC .... A63B 2069/0044; B26B 23/00; B26B 3/04
USPC ..... D8/76; D22/117–118
See application file for complete search history.

(56) References Cited

U.S. PATENT DOCUMENTS 2,280,463 A * 4/1942 Williamson ..... B26B 23/00 7/158
D163,911 S * 7/1951 Sutter ..... D8/76
2,559,689 A * 7/1951 Truesdell ..... B26B 3/06 30/151
2,714,509 A * 8/1955 Ramsey ..... F41B 15/00 273/408
3,366,981 A * 2/1968 Bernard ..... B26B 23/00 7/113
3,599,255 A * 8/1971 Carroll, Sr. ..... B25F 1/00 7/138
3,882,560 A * 5/1975 Carrer ..... B25F 1/02 7/145
D772,035 S * 11/2016 Jones ..... D8/76
D894,709 S * 9/2020 Busch ..... D8/81

* cited by examiner

*Primary Examiner* — Stephen Choi
(74) *Attorney, Agent, or Firm* — David S. Bradin; Nexsen Pruet, PLLC

(57) ABSTRACT

A multi-purpose weapon comprising a handle, an axe blade, and a straight knife blade. The axe blade includes a chopping surface, and two curved surfaces, which, when sharpened, allow the weapon to be used in a similar manner to a kerambit. Thus, in a single weapon, the user can use the straight knife blade, the axe blade, and the one or two curved blades.

11 Claims, 6 Drawing Sheets

PRIOR ART

PRIOR ART

MULTI-BLADED AXE

CROSS-REFERENCE TO RELATED APPLICATIONS

This U.S. application claims priority to U.S. Provisional Application No. 62/901,693, filed Sep. 17, 2019, of which is incorporated herein by reference in its entirety.

FIELD OF THE INVENTION

The present invention relates to a multifunction survival tool and, more particularly, to a survival axe that includes a multifunctional axe blade and a handle which includes a knife blade.

BACKGROUND OF THE INVENTION

In the martial art known as Silat, particularly in the Silat style known as Harimau Berantai Silat, there is an ancient weapon known as a "kapak kecil," which is Malaysian for "small axe." The weapon was brought to Pattani Siam in the 15th century, and later by a family of 'pandai besi' or blacksmith from Madjapahit Java. Here, this secret weapon transformed and evolved into a weapon used by assassins. It was very popular, until around the 3rd quarter of the twentieth century, when the weapon was banned by the authorities in Malaysia.

A picture of the kapak kecil is shown in FIG. 1. Small in size, it measures between 3 cm to 15 cm. A small axe blade is attached to a wooden handle, and the end of the handle is sharpened, to allow the axe to be used as a stabbing weapon. There are various methods of holding the kapak kecil in Harimau Berantai Silat, including blade up, blade down and punching/slashing methods where the axe blade is held between the user's fingers (the latter of which is shown in FIG. 2).

An understanding of the anatomy of the kapak kecil is helpful to understand the effectiveness of the weapon. The weapon is divided into two parts—the mata (blade) and the batang (handle). The mata consists of the kepala or the hammer head for striking, and kekapak, which is the pointed and sharp end of the kapak, for tearing, slashing and hacking. The batang was typically made from one of several species of tropical hardwoods, the most popular of which is 'kayu nibung'.

This wood is not only extremely hard, but also possesses a natural poison, making it potentially lethal when it enters the blood stream. For this reason, the batang was used to trap and stab the opponent.

The kapak kecil is considered to be a reasonable weapon when used for defense, but due to the limitations of the axe blade, is not typically recommended for attacking.

The Harimau Berantai clan of Silat includes the kapak kecil in its arsenal, particularly among the Srikandi (i.e., female warriors), but also among the pendekar (male warriors), who often carry them as a weapon of last resort. Originally a tool for cutting fruits and other foodstuffs, the kapak kecil is always kept extremely sharp. In order to be safe from any accidental cuts, it is normally sheathed.

As the art of the axe fighting has progressed and evolved over the years, axes used in combat have tended to be much larger. Large axes have long been a choice for big and strong warriors, and have been used in many battles throughout the centuries before the arrival of firearms.

The weapon has not been updated in many centuries, and given the modernization of Silat, and its adaptation to be able to counter other modern fighting styles, it would be advantageous to modernize and improve on this ancient weapon. The present invention is a modernization of, and improvement to, the traditional kepak kecil.

SUMMARY OF THE INVENTION

In one embodiment, a multi-function weapon is disclosed, which is referred to by the present inventor as "Berantai Lightning." The weapon includes a handle with two ends, where an axe blade is present at one end, and a straight knife blade is present at other end. The axe blade includes one or two curved surfaces along the top and/or bottom of the axe blade, which enable the weapon to be used in a similar manner as a kerambit. Thus, a single weapon can serve (at least) three functions—it can be used as a straight bladed knife, an axe, and a kerambit.

The axe blade and straight knife blade each range in thickness (at their thickest portions, which taper down in thickness at the edge of the blade) from between around 0.125 to around 0.375" in thickness, and is preferably around 0.25" in thickness. These measurements are not absolute, and longer and thicker blades are envisioned.

The axe blade and straight knife blade can be made of any type of material that can be sharpened and hold an edge, but is preferably made of a steel that can maintain a sharp edge in use, and/or also be struck against a fire-starting material, such as a flint, or ferrocerium rod, to generate sparks.

The overall length of the weapon is between around 7 and about 11 inches, more typically between around 8 and 10 inches, and most preferably, around 9.5 inches, including the straight knife blade, the axe blade, and the handle.

The axe blade is generally in a shape shown in FIG. 5, where the axe blade extends between about 2 and 4 inches from the handle, preferably between about 2.5 and about 3.5 inches from the handle. The axe blade has a width of between about 0.5 and 1.5 inches where it attaches to the handle, and widens as it extends outwardly to a final width of between about 2.5 and 3.5 inches.

The axe blade has a sharp edge (a chopping edge) furthest from, and perpendicular to, the handle. The chopping edge can be used to hack at objects, such as trees, vines, animals, attackers, and the like.

As the axe blade transitions toward the handle, it gets narrower, and includes two curves, one on the top, and the other on the bottom, of the axe blade.

In one aspect of this embodiment, the axe blade is not sharpened close to the handle, and by leaving a portion of the axe blade available so the user can grab the blade at this position, as is shown in FIG. 2. That is, when the weapon is used as a fighting implement, the user can hold the handle, or grip the axe blade in the unsharpened portions.

The remainder of the curvature is sharpened, on one, or, preferably, both sides, allowing the blade to function in a similar manner as a kerambit. When both sides of the curvature are sharpened, the weapon can be used like a kerambit whether the straight knife blade is facing up or facing down.

That is, when the axe blade is facing up, and the straight knife blade is pointing downward from the user's hand, the upper curvature of the axe blade can be used like a kerambit when the weapon is thrust upwards, and the lower curvature of the axe blade can be used like a kerambit when the weapon is thrust downwards. The opposite is true when the knife blade is pointing upward from the user's hand.

In one embodiment, there is a sharp point or blade at the top of the handle, near the intersection where the axe blade meets the handle. This point is in the same plane as the axe blade. In another embodiment, rather than including a sharp point at this position, there is a flat surface, which can be shaped like a hammer, so that when the knife is facing upward in the user's hands, and the axe blade is facing downward from the user's hands, a downward strike with the "hammer" portion of the handle can cause damage.

This additional point and/or blade can serve an additional function. One such function is that, when the axe is thrown, it provides an additional point that can penetrate the object at which the axe is thrown, such as a tree or an animal. Alternatively, this point and/or blade can be a skinning blade, used for taking the skin off of animals or for precisely cutting animals open, or as a hole puncher, which can be used, for example, to punch holes in cans and other containers, including natural ones such as coconuts and bamboo shoots. The hole puncher can also be used to aid in digging small holes in the ground, or, for example, puncturing an animal hide so as to create make shift clothing and/or shelter using the hide.

The straight knife blade portion of the weapon can extend from one to five inches from the end of the handle portion of the weapon, i.e., beyond where the user's grip on the handle terminates. Preferably, the straight blade portion is at least two inches, and no more than four inches, in length. The blade can be wider or narrower than the width of the handle, though preferably less than 50% wider or narrower. One or both sides of the knife blade can be sharpened.

In use, it may be desirable, in some embodiments, to cover the straight knife blade while using the axe blade. In one aspect of these embodiments, there is a lock on the handle, proximate to the straight knife blade, for engaging a blade cover, where the blade cover covers the entire length of the straight knife blade portion of the weapon, and engages into the lock.

Similarly, in use, it may be desirable, in some embodiments, to cover the axe blade while using the knife blade. An axe blade cover may therefore be present. In one aspect, the axe blade cover fits over the axe blade. The cover can include a strap that the user can snap, tie or otherwise hold in place on the handle behind the axe blade.

The handle, or at least the portion of the handle not attached to the axe blade, and which is in contact with the user's hand, is preferably at least long enough to accommodate the user's hand, but can extend up to two to three inches longer than the user's hand. The handle can be flat, round, oval, or any other suitable shape that allows the user to hold onto the weapon in use. The handle can be made of wood, antler, or other natural materials, metal, or plastic, and can be wrapped, if desired. Where the handle is wrapped, the material used to wrap the handle can be, for example, rope, leather strips, and/or cord, including paracord.

The handle can include checkering and/or carving, for decoration and/or to increase the ability of the user to firmly grip the handle.

The handle typically has a width of between about 0.5 and 1.75 inches, and is more typically about 1 inch in width, but this can vary depending on width of the user's hands.

In one embodiment, the handle includes a curved recess, or finger groove, at a position near the top and/or bottom of axe blade, so the user can grab the axe by the recess(es) without getting injured by the axe blade.

In another embodiment, the handle includes one or more curved recesses, or finger grooves, along its length, adapted to receive one or more of a user's fingers, so that a user can grab the handle without it easily slipping through the user's hands.

In yet another embodiment, the handle includes a ring, much like the ring portion of a kerambit, through which a user can insert a finger, preventing the weapon from being easily dislodged from the user's hand, and/or allowing the user to rotate the weapon.

In still other embodiments, the handle and/or straight knife blade includes one or more of a bolster, ricasso, thumb rise, choil, nick, notch, jimping, quillion and/or guard, to help minimize the chance of the user's hand contacting the straight knife blade.

In some embodiments, the handle is attached to a string, so the weapon can be pulled back after being thrown, or to a leash, so it can be more easily retained.

In one embodiment, the entire weapon, other than the handle, is forged or shaped from a single piece of metal (i.e., is a "full tang" weapon), where wood or other materials are affixed to the handle portion, leaving the axe blade and straight knife blade exposed. In other embodiments, the axe blade and/or the straight knife blade is affixed to the handle.

Where the straight knife blade and/or axe blade does not include a full tang, it is ideally fixedly attached to the handle by being positioned within a groove, slot or recess in the handle sized to receive the blade. The axe blade can be affixed to the handle using adhesives and/or mechanical fasteners such as screws, rivets, nuts and bolts, collets, and the like.

In one embodiment, one or both of the axe blade and straight knife blade is removeably attached to a handle, and one way to accomplish this is by using an appropriate string or cord, made of natural or synthetic materials, to secure the blade in the handle. In this embodiment, the blade can be removed from the handle for certain tasks, then reinserted into the handle when the task being performed with the blade outside of the handle is complete. In one aspect of this embodiment, the back portion of the knife and/or axe blade can be wrapped with the string or cord, held in the users hand, and used much in the way a knife or axe would be used, depending on which part of the blade was being used.

In another embodiment, the axe blade, handle, and/or straight knife blade can include a circular hole, which wood can be forced through. Ideally, the hole is appropriately sized so as to form arrows for hunting, and an appropriate size range is between about 0.25 and 0.75" in diameter. The hole may be sharpened at one end to facilitate passing the wood through the hole.

In one embodiment, when the weapon is intended to be used in outdoor survival applications, a fire starter is included in the wrapping, so that when the handle is unwrapped, the fire starter is released. In another embodiment, the knife blade is removably attached to the handle, and, when removed, exposes an opening, or hollow compartment in the handle which can be used, for example, for storing emergency gear. Various survival implements can be stored in the handle, including fire starters, including matches, flint and steel, ferrocerium, and magnesium, fishing line, fishing hooks, water purification tablets, a compass, a mirror, first aid supplies, cordage, including paracord, dental floss, and the like. In one aspect of this embodiment, the straight knife blade is releaseably affixed to the handle, for example, by screwing it in place, and when released from the handle, can reveal a recess/storage compartment.

In one embodiment, each bladed edge is purposefully made dull, so that the axe can be used for training purposes with minimal risk. In this embodiment, the entire axe can be formed of plastic, wood, or metal, such as aluminum.

In another embodiment, the entire weapon is formed from a single piece of metal, and includes no additional components.

These objects, and others that will become apparent upon reference to the following detailed description and accompanying drawings, are provided by a multi-purpose weapon comprising an axe blade and a straight knife blade.

DETAILED DESCRIPTION OF THE PREFERRED EMBODIMENT

Turning to the figures of the drawings, which are for purposes of illustration and not limitation, there is seen a multi-function weapon embodying the present invention.

In one embodiment, a multi-function weapon is disclosed, which is referred to by the present inventor as "Berantai Lightning."

In one aspect of this embodiment, the weapon includes a handle with two ends, where an axe blade is present at one end, and a straight knife blade is present at other end. The axe blade includes one or two curved surfaces along the top and/or bottom of the axe blade, which enable the weapon to be used in a similar manner as a kerambit. Thus, a single weapon can serve (at least) three functions—it can be used as a straight bladed knife, an axe, and a kerambit.

In another aspect, the entire wooden handle is removed, in favor of forming the entire weapon from a single piece of metal. This aspect offers additional rigidity, as there is a "full tang" from end to end. In some embodiments, even where the weapon is formed of a single piece of metal, the handle portion (i.e., that portion of the weapon that is not the axe blade or the knife blade) can be wrapped with leather, paracord, and the like, to form a more comfortable grip, or knife scales can be attached to one or both sides of the metal to provide a better gripping surface for the user.

Figure 1:
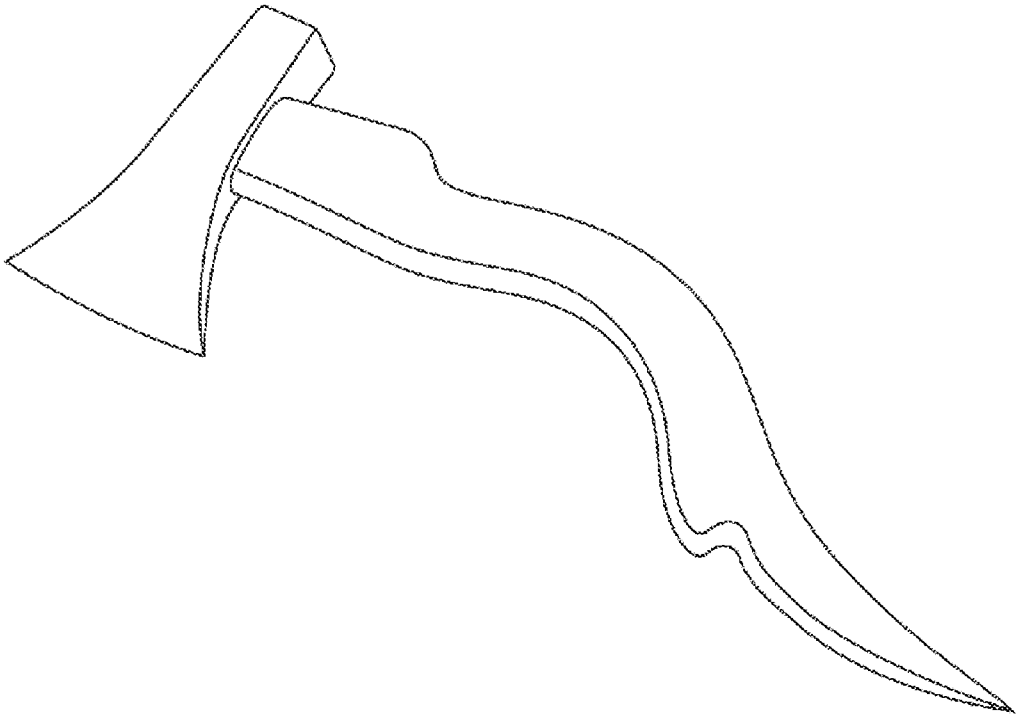
FIG. 1 is a photograph of a traditional small axe (kapak kecil) used in Silat.

Historically, a small axe (known in Malaysia as a "kapak kecil") had a sharpened wooden handle (known in Malaysia as a "batang"), as shown in FIG. 1. The wood shown in FIG. 1 is 'kayu nibung', which is not only extremely hard, but also possesses a natural poison.

In some embodiments described herein, the sharpened end of the wooden handle is replaced with a knife blade. This removes the poison element of the axe, but creates a far more lethal weapon due to the sharpened metal blade.

Figure 3:
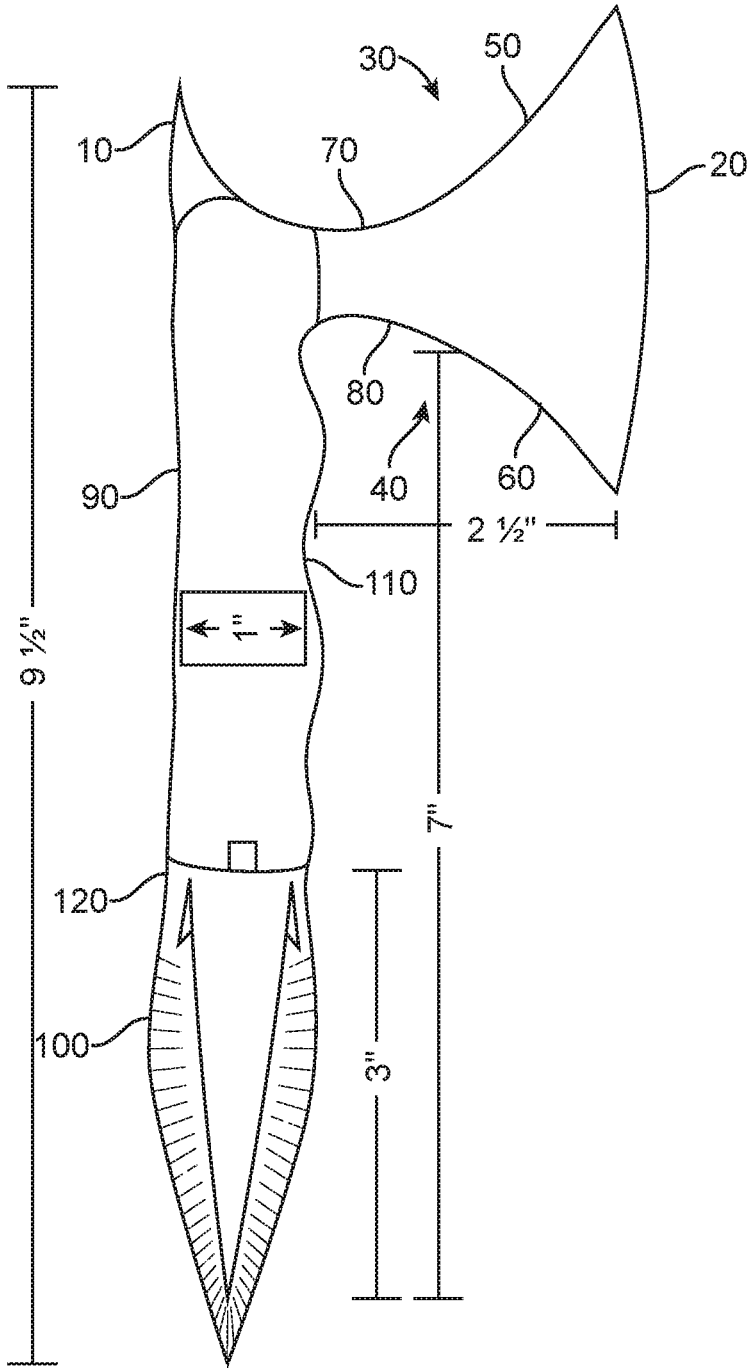
FIG. 3 is a drawing showing one embodiment of the multipurpose weapon described herein, including the handle, a point at the uppermost portion of the handle, an axe blade with a chopping surface and two curved surfaces, and a knife blade, where relative lengths and widths of one embodiment of each portion of the weapon are shown.
Figure 4:
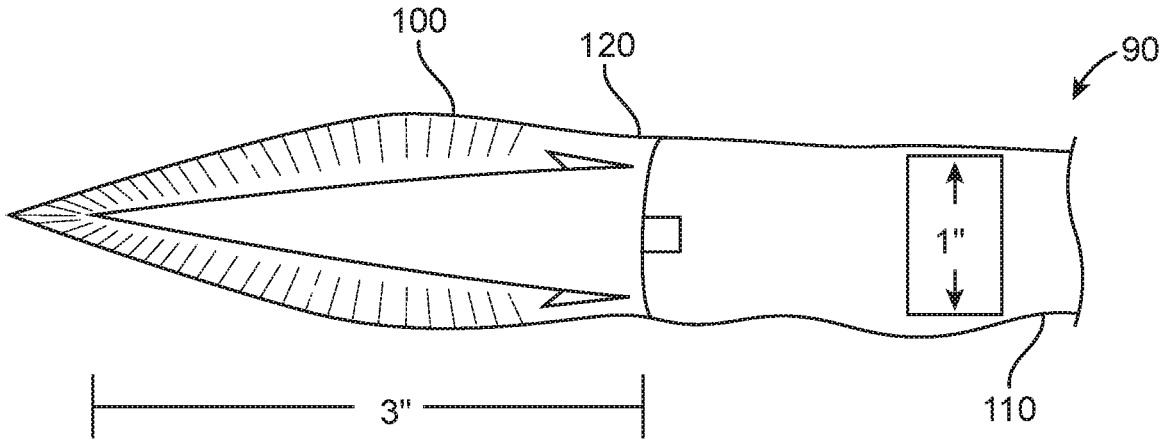
FIG. 4 is a drawing showing a portion of the handle (90) of one embodiment of the weapon described herein, where the handle (90) includes a recess (110) and a lock (120) adapted to receive a blade cover, which blade cover (not shown) is intended to fit over the blade (100) and lock in place on the handle. The relative lengths of the handle and blade, the overall length of the weapon, and the width of the handle, in this embodiment, are shown in the figure.

One embodiment of the weapon is shown in FIG. 3. In this embodiment, the weapon, as shown, includes an axe blade, a sharpened point (10) at the end of the handle (which is not present in all embodiments of the weapon), a handle (90), which can include one or more recesses (110) and a knife blade (100).

The axe blade includes an edge for chopping (20), as well as two curved edges (30 and 40). These curved edges include sharpened portions (50 and 60) and non-sharpened portions (70 and 80), where the non-sharpened portions can be grasped by users without cutting themselves.

In the embodiment shown, a locking mechanism (120) is present at or near where the blade connects with/emerges from the handle.

In the embodiment shown in FIG. 3, the sharpened point (10) does not include a blade, only a sharp point, but in other embodiments, can include a sharpened blade. As shown in FIG. 3, the distance from the rear-most portion of the handle to the end of the axe blade is around 3.5 inches, and the axe blade is around 3.5 inches long. The entire length of the weapon is around 9.5 inches. The knife blade is around 3 inches in length. The handle is around 1 inch thick.

The axe blade includes a cutting surface much like a conventional axe blade, but also includes two curved portions. The curved portions include sharp portions closer to the cutting surface, and dull portions close to the handle, enabling the user to grip the axe blade by the dull portions, rather than the handle, if such is desired.

The weapon has aspects of three different weapons in one, namely, a small axe (known in Silat as a kepak kecil), a kerambit, and a knife. Depending on the blade shape, the knife portion could function as a belati, a dagger, a dirk, an ice pick, and the like.

The various components and features of the weapon are described in more detail below.

I. The Axe and Knife Blades

The axe blade and straight knife blade each range in thickness (at their thickest portions, which taper down in thickness at the edge of the blade) from between around 0.125 to around 0.375" in thickness, and is preferably around 0.25" in thickness. These measurements are not absolute, and longer and thicker blades are envisioned.

The axe blade and straight knife blade can be made of any type of material that can be sharpened and hold an edge, but is preferably made of a steel that can maintain a sharp edge in use, and/or also be struck against a fire-starting material, such as a flint, or ferrocerium rod, to generate sparks.

The overall length of the weapon is between around 7 and about 11 inches, more typically between around 8 and 10 inches, and most preferably, around 9.5 inches, including the straight knife blade, the axe blade, and the handle.

The knife blade is generally between about 1 and about 5 inches in length, more particularly, between about 2 and about 4 inches in length, and still more particularly, between about 2.5 and about 3.5 inches in length, though longer lengths are within the scope of the invention.

Figure 5:
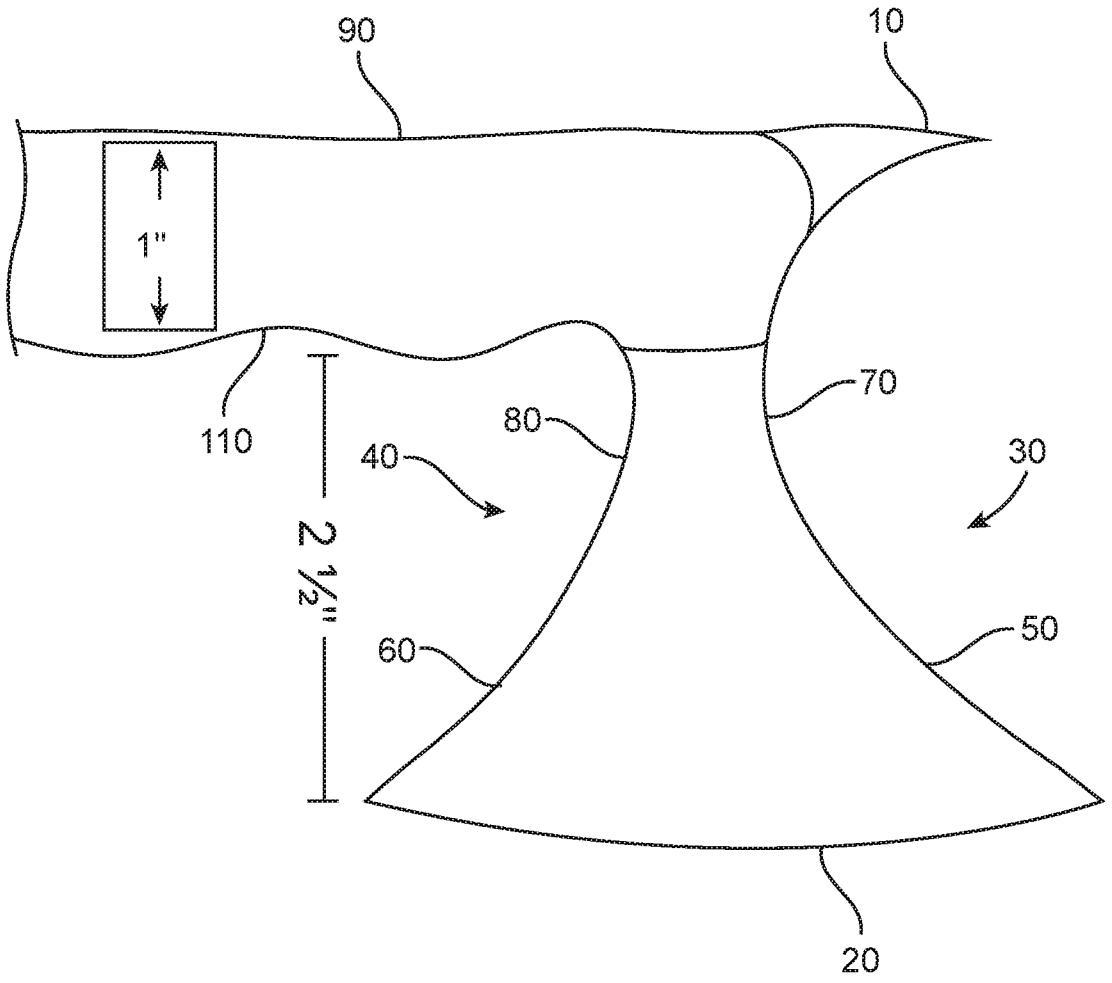
FIG. 5 is a drawing showing a portion of one embodiment of the weapon described herein, focusing on the axe blade and that portion of the handle proximate the axe blade, where the uppermost portion of the handle includes a sharp point, which in this embodiment is a point, but not a blade. The chopping and curved surfaces of the axe blade are shown, and the sharpened and unsharpened portions of the curved surfaces of the axe blade are also shown.

The axe blade is generally in a shape shown in FIG. 5, where the axe blade extends between about 2 and 4 inches from the handle (90), preferably between about 2.5 and about 3.5 inches from the handle. The axe blade has a width of between about 0.5 and 1.5 inches where it attaches to the handle, and widens as it extends outwardly to a final width of between about 2.5 and 3.5 inches.

The axe blade has a sharp edge (a chopping edge, 20) furthest from, and perpendicular to, the handle. The chopping edge can be used to hack at objects, such as trees, vines, animals, attackers, and the like.

As the axe blade transitions toward the handle, it gets narrower, and includes two curves, one on the top (30), and the other on the bottom (40), of the axe blade.

Figure 2:
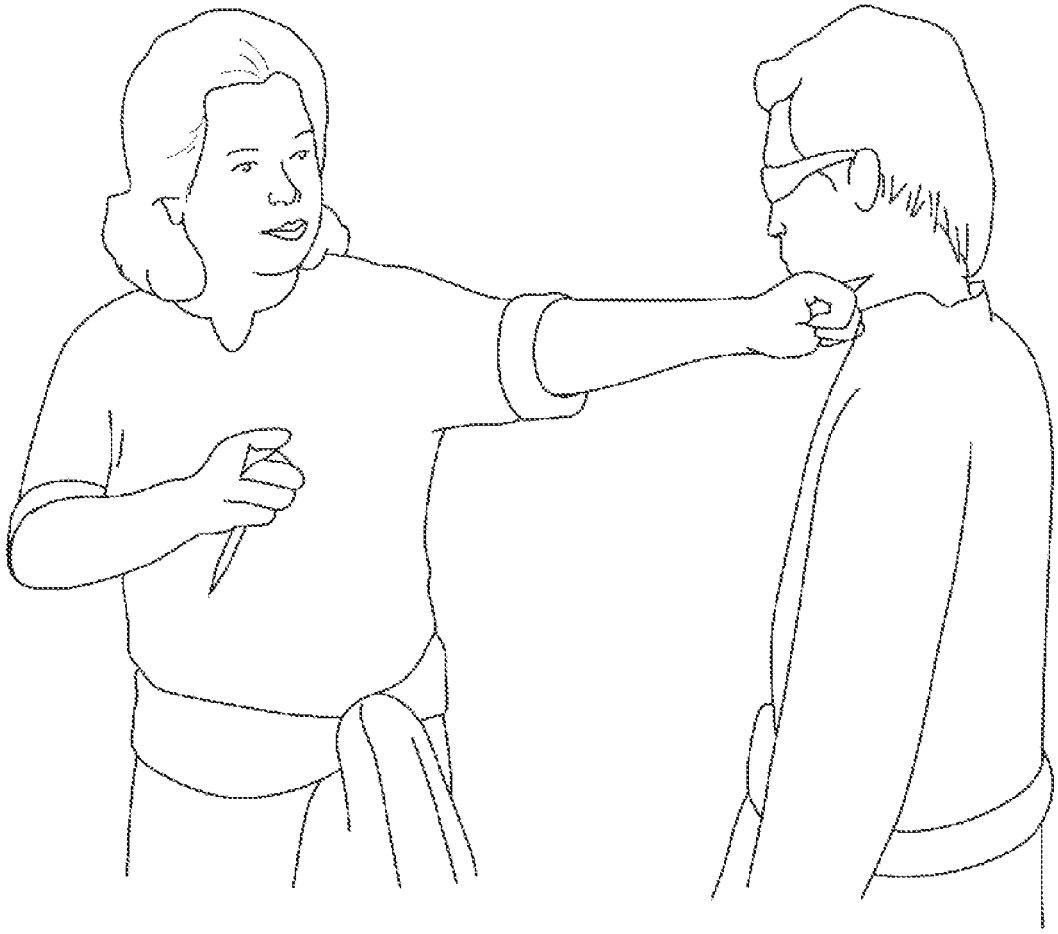
FIG. 2 is a photograph of the inventor of the multi-purpose weapon described herein holding two representative weapons by the unsharpened portion of the curved portion of the axe blades rather than by the handle.

In one aspect of this embodiment, the axe blade includes sharpened portions (50 and 60), but is not sharpened close to the handle (70/80), by leaving a portion of the axe blade available so the user can grab the blade at this position, as is shown in FIG. 2. That is, when the weapon is used as a fighting implement, the user can hold the handle, ideally with one or more fingers present in indentations in the handle (110) to provide a stronger grip than a straight handle provides, or grip the axe blade in the unsharpened portions.

The remainder of the curvature is sharpened, on one, or, preferably, both sides, allowing the blade to function in a similar manner as a kerambit. When both sides of the curvature are sharpened, the weapon can be used like a kerambit whether the straight knife blade is facing up or facing down.

That is, when the axe blade is facing up, and the straight knife blade is pointing downward from the user's hand, the upper curvature of the axe blade can be used like a kerambit when the weapon is thrust upwards, and the lower curvature of the axe blade can be used like a kerambit when the weapon is thrust downwards. The opposite is true when the knife blade is pointing upward from the user's hand.

In one embodiment, there is a sharp point or blade at the top of the handle, near the intersection where the axe blade meets the handle. This point is in the same plane as the axe blade. In another embodiment, rather than including a sharp point at this position, there is a flat surface, which can be shaped like a hammer, so that when the knife is facing upward in the user's hands, and the axe blade is facing downward from the user's hands, a downward strike with the "hammer" portion of the handle can cause damage.

This additional point and/or blade can serve an additional function. One such function is that, when the axe is thrown, it provides an additional point that can penetrate the object at which the axe is thrown, such as a tree or an animal. Alternatively, this point and/or blade can be a skinning blade, used for taking the skin off of animals or for precisely cutting animals open, or as a hole puncher, which can be used, for example, to punch holes in cans and other containers, including natural ones such as coconuts and bamboo shoots. The hole puncher can also be used to aid in digging small holes in the ground, or, for example, puncturing an animal hide so as to create make shift clothing and/or shelter using the hide.

The straight knife blade portion of the weapon can extend from one to five inches from the end of the handle portion of the weapon, i.e., beyond where the user's grip on the handle terminates. Preferably, the straight blade portion is at least two inches, and no more than four inches, in length. The blade can be wider or narrower than the width of the handle, though preferably less than 50% wider or narrower. One or both sides of the knife blade can be sharpened.

In use, it may be desirable, in some embodiments, to cover the straight knife blade while using the axe blade. In one aspect of these embodiments, there is a lock on the handle (FIG. 5, 120), proximate to the straight knife blade, for engaging a blade cover, where the blade cover covers the entire length of the straight knife blade portion of the weapon, and engages into the lock.

Similarly, in use, it may be desirable, in some embodiments, to cover the axe blade while using the knife blade, and vice versa. One or both of an axe blade cover/sheath and/or knife blade cover/sheath may therefore be present. In one aspect, the axe blade cover fits over the axe blade and/or the knife blade cover fits over the knife blade. The covers can include a strap that the user can snap, tie or otherwise hold in place on the handle behind the axe blade.

Figure 6:
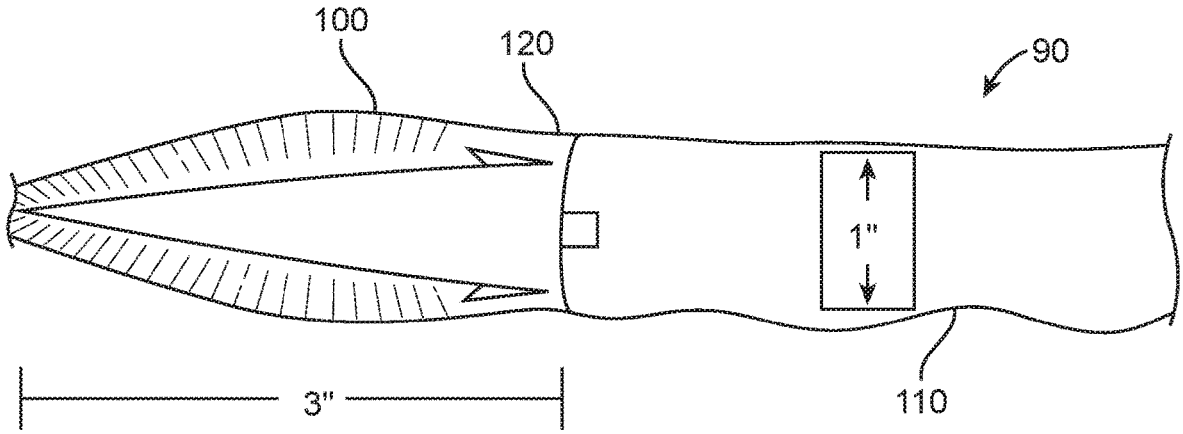
FIG. 6 is a drawing showing an embodiment where there is a locking mechanism suitable for locking a blade cover, or sheath, over the blade. As shown, the locking mechanism is a switch, which, when depressed, releases the sheath/blade cover (not shown).

In the embodiment shown in FIG. 6, the handle (90) includes a locking mechanism (120), such as a switch, which engages with a sheath/blade cover (not shown) and locks the sheath/blade cover in place over the knife blade (100) until the locking mechanism is released, such as by depressing the switch.

II. The Handle

The handle, or at least the portion of the handle not attached to the axe blade, and which is in contact with the user's hand, is preferably at least long enough to accommodate the user's hand, but can extend up to two to three inches longer than the user's hand. The handle can be flat, round, oval, or any other suitable shape that allows the user to hold onto the weapon in use. The handle can be made of wood, antler, or other natural materials, metal, or plastic, and can be wrapped, if desired. Where the handle is wrapped, the material used to wrap the handle can be, for example, rope, leather strips, and/or cord, including paracord.

The handle can include checkering and/or carving, for decoration and/or to increase the ability of the user to firmly grip the handle.

The handle typically has a width of between about 0.5 and 1.75 inches, and is more typically about 1 inch in width, but this can vary depending on width of the user's hands.

In one embodiment, the handle includes a curved recess, or finger groove, at a position near the top and/or bottom of axe blade, so the user can grab the axe by the recess(es) without getting injured by the axe blade.

In another embodiment, the handle includes one or more curved recesses, or finger grooves, along its length, adapted to receive one or more of a user's fingers, so that a user can grab the handle without it easily slipping through the user's hands.

In yet another embodiment, the handle includes a ring, much like the ring portion of a kerambit, through which a user can insert a finger, preventing the weapon from being easily dislodged from the user's hand, and/or allowing the user to rotate the weapon.

In still other embodiments, the handle and/or straight knife blade includes one or more of a bolster, ricasso, thumb rise, choil, nick, notch, jimping, quillion and/or guard, to help minimize the chance of the user's hand contacting the straight knife blade.

In some embodiments, the handle is attached to a string, so the weapon can be pulled back after being thrown, or to a leash, so it can be more easily retained.

In one embodiment, the entire weapon, other than the handle, is forged or shaped from a single piece of metal (i.e., is a "full tang" weapon). In some aspects of this embodiment, the weapon consists essentially of this single piece of metal, whereas in other aspects, wood or other materials (i.e., knife scales) are affixed to the handle portion, leaving the axe blade and straight knife blade exposed. In other embodiments, the axe blade and/or the straight knife blade is affixed to the handle.

Where the straight knife blade and/or axe blade does not include a full tang, it is fixedly attached to the handle by being positioned within a groove, slot or recess in the handle sized to receive the blade. The axe blade can be affixed to the handle using adhesives and/or mechanical fasteners such as screws, rivets, nuts and bolts, collets, and the like.

In one embodiment, one or both of the axe blade and straight knife blade is removeably attached to a handle, and one way to accomplish this is by using an appropriate string or cord, made of natural or synthetic materials, to secure the blade in the handle. In this embodiment, the blade can be removed from the handle for certain tasks, then reinserted into the handle when the task being performed with the blade outside of the handle is complete. In one aspect of this embodiment, the back portion of the knife and/or axe blade can be wrapped with the string or cord, held in the users hand, and used much in the way a knife or axe would be used, depending on which part of the blade was being used.

III. Survival Tool

In various embodiments, the weapon is intended for use in survival applications.

In one such embodiment, the axe blade, handle, and/or straight knife blade can include a circular hole, through which wood can be forced. Ideally, the hole is appropriately sized so as to form arrows for hunting, and an appropriate size range is between about 0.25 and 0.75" in diameter. The hole may be sharpened at one end to facilitate passing the wood through the hole.

In another embodiment, a fire starter is included in the wrapping, so that when the handle is unwrapped, the fire starter is released. In yet another embodiment, the knife blade is removably attached to the handle, and, when removed, exposes an opening, or hollow compartment in the handle which can be used, for example, for storing emergency gear. Various survival implements can be stored in the handle, including fire starters, including matches, flint and steel, ferrocerium, and magnesium, fishing line, fishing hooks, water purification tablets, a compass, a mirror, first aid supplies, cordage, including paracord, dental floss, and the like. In one aspect of this embodiment, the straight knife blade is releaseably affixed to the handle, for example, by screwing it in place, and when released from the handle, can reveal a recess/storage compartment.

IV. Training Applications

In one embodiment, each bladed edge is purposefully made dull, so that the axe can be used for training purposes with minimal risk. In this embodiment, the entire axe can be formed of plastic, wood, or metal, such as aluminum.

If desired, one or more of the blades, though not sharpened, can be made of a conductive material, and the handle can house a mechanism for providing an electric shock when placed in contact with human skin, similar to the "Shock Knife." This allows the training weapon to provide more realistic training, as the person being attacked has a genuine fear of getting shocked, though not of getting stabbed, so will tend to defend the attack more vigorously than when there is no threat of being shocked.

V. Use of the Axe

In use, the handle allows one to grip the weapon in any of a number of different ways.

When the knife blade is facing downward, one can thrust downward with the knife blade, slash or chop with the axe blade, and/or use the curved portions of the axe blade in a similar manner as a kerambit.

When the knife blade is facing upward, one can slash or stab with the knife blade, slash with the axe blade, and/or use the curved portions of the axe blade in a similar manner as a kerambit.

In some embodiments, as shown in FIG. 2, one can hold the weapon with the unsharpened portions of the axe blade between one's fingers, and thrust or slash using the axe blade, while also being able to strike downward with the knife blade. In these embodiments, the axe blade can be used in a manner analogous to a push dagger.

Thus, it can be seen that a multi-function weapon has been provided that is compact and requires little or no assembly, while being able to be used to perform a great number of different tasks. While the invention has been described in terms of a preferred embodiment, there is no intent to limit the invention to the same. On the contrary, it is intended to cover all equivalents and modifications within the scope of the appended claims.

What is claimed is:

1. A multi-bladed weapon comprising:

a) a handle with a top and a bottom, b) an axe blade attached to the top of the handle, and c) a straight knife blade, at least a portion of which is sharpened, attached to the bottom of the handle, wherein the axe blade comprises a chopping surface and two curved surfaces located between the handle and the chopping surface, one or both of the curved surfaces are sharpened except in the area proximate to the handle, where a portion of the curved surfaces at least a half inch in length is unsharpened.

2. The weapon of claim 1, wherein the weapon is prepared from a single piece of metal, and the handle is a portion of the piece of metal.

3. The weapon of claim 1, wherein the handle includes a locking mechanism proximate to the knife blade, with which to attach a sheath.

4. The weapon of claim 1, wherein the handle comprises one or more curved recesses and/or finger grooves.

5. The weapon of claim 1, wherein the overall length of the weapon is between around 7 and about 11 inches.

6. The weapon of claim 1, wherein the overall length of the weapon is between around 8 and 10 inches.

7. The weapon of claim 1, wherein the overall length of the knife blade is between about 1 and about 5 inches.

8. The weapon of claim 7, wherein the overall length of the knife blade is between about 2 and about 4 inches.

9. The weapon of claim 7, wherein the overall length of the knife blade is between about 2.5 and about 3.5 inches.

10. The weapon of claim 1, wherein the axe blade extends between about 2 and 4 inches from the handle.

11. The weapon of claim 1, wherein the axe blade has a width of between about 0.5 and 1.5 inches where it attaches to the handle, and widens as it extends outwardly to a final width of between about 2.5 and 3.5 inches.

* * * * *